US006463909B2

(12) United States Patent
Asada et al.

(10) Patent No.: US 6,463,909 B2
(45) Date of Patent: Oct. 15, 2002

(54) COMMON RAIL

(75) Inventors: Kikuo Asada, Mishima; Shoichiro Usui, Sendai, both of (JP)

(73) Assignee: Usui Kokusai Sangyo Kaisha Limited (JP)

( * ) Notice: Subject to any disclaimer, the term of this patent is extended or adjusted under 35 U.S.C. 154(b) by 34 days.

(21) Appl. No.: 09/747,084

(22) Filed: Dec. 21, 2000

(65) Prior Publication Data

US 2001/0009148 A1 Jul. 26, 2001

(30) Foreign Application Priority Data

Jan. 25, 2000 (JP) ..... 2000-015876

(51) Int. Cl.[7] ..... F02M 41/00
(52) U.S. Cl. ..... 123/456; 285/133.4
(58) Field of Search ..... 123/456, 447; 239/533.2; 285/133.11, 133.4, FOR 138, FOR 132, 332

(56) References Cited

U.S. PATENT DOCUMENTS

| | | | | |
|---|---|---|---|---|
| 4,832,376 A | | 5/1989 | Sugao | |
| 4,893,601 A | | 1/1990 | Sugao | |
| 4,900,180 A | | 2/1990 | Takikawa | |
| 5,120,084 A | | 6/1992 | Hashimoto | |
| 5,143,410 A | | 9/1992 | Takikawa | |
| 5,169,182 A | | 12/1992 | Hashimoto | |
| 5,172,939 A | | 12/1992 | Hashimoto | |
| 5,667,225 A | | 9/1997 | Kato | |
| 5,692,476 A | * | 12/1997 | Egler et al. | 123/456 |
| 5,887,910 A | | 3/1999 | Usui | |
| 5,957,507 A | | 9/1999 | Asada | |
| 5,979,945 A | | 11/1999 | Hitachi et al. | |
| 5,992,904 A | | 11/1999 | Hitachi et al. | |
| 6,050,611 A | | 4/2000 | Asada | |
| 6,126,208 A | | 10/2000 | Asada et al. | |
| 6,213,095 B1 | * | 4/2001 | Asada et al. | 123/456 |

FOREIGN PATENT DOCUMENTS

| | | | |
|---|---|---|---|
| JP | 2-802289 | | 6/1990 |
| JP | 3-177693 | | 8/1991 |
| JP | 4-175462 | | 6/1992 |
| JP | 2000-27731 | * | 1/2000 |

* cited by examiner

*Primary Examiner*—Willis R. Wolfe
*Assistant Examiner*—Mahmoud Gimie
(74) *Attorney, Agent, or Firm*—Anthony J. Casella; Gerald E. Hespos

(57) ABSTRACT

A common rail has a main pipe rail with a peripheral wall. A boss is provided on the peripheral wall, and a branch hole extends through the boss and into the main pipe rail. The branch hole has a pressure receiving seat face. A branch pipe has a pressing seat face that is urged into the pressure receiving seat face by a fastening nut. An orifice pipe is mounted in the branch hole and abuts against an end of the branch pipe without effecting sealing performance between the pressing seat face and the pressure receiving seat face.

8 Claims, 8 Drawing Sheets

COMMON RAIL

BACKGROUND OF THE INVENTION

1. Field of the Invention

The present invention generally relates to a common rail such as a high pressure fuel manifold or a block rail in a diesel internal combustion engine.

2. Description of the Prior Arts

Conventionally as a common rail of this kind,for example, as shown in FIG. 7, there is known a common rail oft a type in which each of a plurality of pieces of boss portions 31-4 provided, at intervals, at a peripheral wall portion in an axial direction of a circular pipe on a side of a main pipe rail 31 comprising the circular pipe, is perforated with a branch hole 31-2 having a pressure receive seat face 31-3, communicating with a communication path 31-1 of the main pipe rail 31 and opened outwardly, a pressing seat face 32-3 constituted by a connection head portion 32-2 on a side of an injection pipe 32, is brought into contact and engaged with pressure receive eat face 31-3 on the side of the main pipe, rail 31 and is fastened to connect thereto by screwing a fastening outer screw nut (or cap nut) 33 previously integrated to the side of the injection pipe to the boss portion 31-4 in accordance with pressing operation under a neck of the connection head portion 32-2 in the drawing, notation 32-1 designates a flow path of the branch pipe 32 and notation 34 designates a fastening sleeve washer.

In such a common rail, the injection pipe arranged the common rail and a nozzle, is shortened such that a sufficient amount can be injected into a combustion chamber without causing pressure lose in the common rail and in consideration of convenience in view of piping. However, even in such a short injection pipe, when a valve is closed after fuel injection, pressure variation is caused in the injection pipe. The pressure variation becomes pulsation and reaches the communication path 31-1 of the main pipe rail 31, further passes through the branch hole 31-2 and influences on an injection pipe of a successive cylinder and accordingly, there poses a problem in which fuel can not be injected stably.

Although as a countermeasure thereagainst, the pressure variation can be reduced by, for example, increasing an inner diameter of the main pipe rail 31 to thereby increase an inner volume of the pipe, there causes a drawback that the pulsation is transmitted fastly. Hence, there has been developed a method of providing an orifice in a common rail in order to restrain pulsation lowly and retarding propagation thereof. With regard to the method, there are known a method for providing orifice function by further reducing a diameter of the branch hole 31-2 provided at the boss portion 31-4 of the main pipe rail 31 and a method in which as shown by FIG. 8, a metal ring member (barrel) 35 with an orifice having a pressing seat face 35-1 and a pressure receive seat face 35-2, is interposed between the pressure receive seat face 31-3 of the branch hole 31-2 and the injection pipe connection head portion 32-2 at a portion of the branch hole 31-2 of the main pipe rail 31, and pulsation can be restrained lowly and propagation can be retarded by either of the methods. However, according tot the method, of providing the orifice function by further reducing the diameter of the branch hole, since repeated pressure at high pressure is applied to the branch hole portion, a portion thereof having the thinnest thickness is equal to or large than 7 mm, further, there is carried out fabrication at a portion which is deep from an end face of the boss portion and accordingly, there is a difficulty in which fabrication of a hole having a slender diameter is not easy in forming the orifice. Further, according to the method of interposing the metal ring member (barrel) 35 with an,orifice between the pressure receive seat face 31-3 of the branch hole 31-20 and the injection pipe connection head portion 32-2, by axial force by a single piece of the fastening outer screw nut 33 integrated to the side of the injection pipe, two locations, that is, two locations of a portion of sealing the pressure receive seat face 31-3 of the branch hole and the pressing seat face 35-1 of the metal ring member 35 and a portion of sealing the pressure receive seat face 35-2 of the meal ring member 35 and the pressing seat face 32-3 of the injection pipe connection head portion, are sealed and therefore, there is a drawback of insufficient stability of seal.

SUMMARY OF THE INVENTION

It is an object of the invention to provide,a common rail carried out in order to resolve the above-described conventional problem and capable of injecting fuel stably by restraining pulsations lowly and retarding propagation by providing an orifice pipe in a branch pipe to thereby achieve orifice function.

In order to achieve the above-described object, according to an aspect of invention, there is provided a common rail which is a common rail constituted by providing a branch hole communicating with a communication path and having a pressure receive seat face opened outwardly at each of a plurality of pieces of integrated type boss portions or separate type boss portions provided at a peripheral wall portion in an axial direction of a main pipe rail having the communication path at inside thereof in an axis core direction thereof while maintaining intervals there between, bringing and engaging a pressing seat face portion constituted by a connection head portion having a flow path communicating with the communication path and provided at an end portion thereof in contact with the pressure receive seat face and fastening to connect the pressing seat face portion thereto in accordance with pressing operation under a neck of the connection head portion by screwing a fastening nut, wherein the common rail is constituted by providing an orifice pipe having ant outer diameter at least the same as or smaller than a hole diameter of the branch hole in the branch hole.

Further, as the orifice, pipe, there can be used a constitution in which the orifice pipe includes a thick-walled flange portion having a diameter larger than a flow path diameter of an injection pipe at an end portion of the injection pipe on a side of the connection head portion, or a constitution in which the orifice pipe comprises a pipe member made of a hard metal and a ring made of a soft metal having a diameter larger than a flow path diameter of the injection pipe outwardly fitted to an end portion of the pipe member on a side of the connection head portion or a constitution in which the orifice pipe comprises an inner pipe made of a hard metal and an outer pipe made of a soft metal having a thick-walled flange portion having a diameter larger than the flow path diameter of the injection pipe at the end portion of the injection pipe on the side of the connection head portion.

That is, the invention is constituted such that by providing the orifice pipe in the branch hole of the main pipe rail, the orifice pipe serves :as an orifice and does not influence seal performance and fuel can be injected stably by restraining pulsation lowly and retarding propagation. Further, in the case of the orifice pipe having the flange portion, when the flange portion is soft, axial force of a nut is not cancel thereby and seal face pressure is not lowered.

Further, as means for fixing the orifice pipe, according to the invention, there can be used means of press-fitting, calking, shrinkage fitting, chill fitting, soldering, bonding or the like.

DETAILED DESCRIPTION OF PREFERRED EMBODIMENTS

Figure 1:
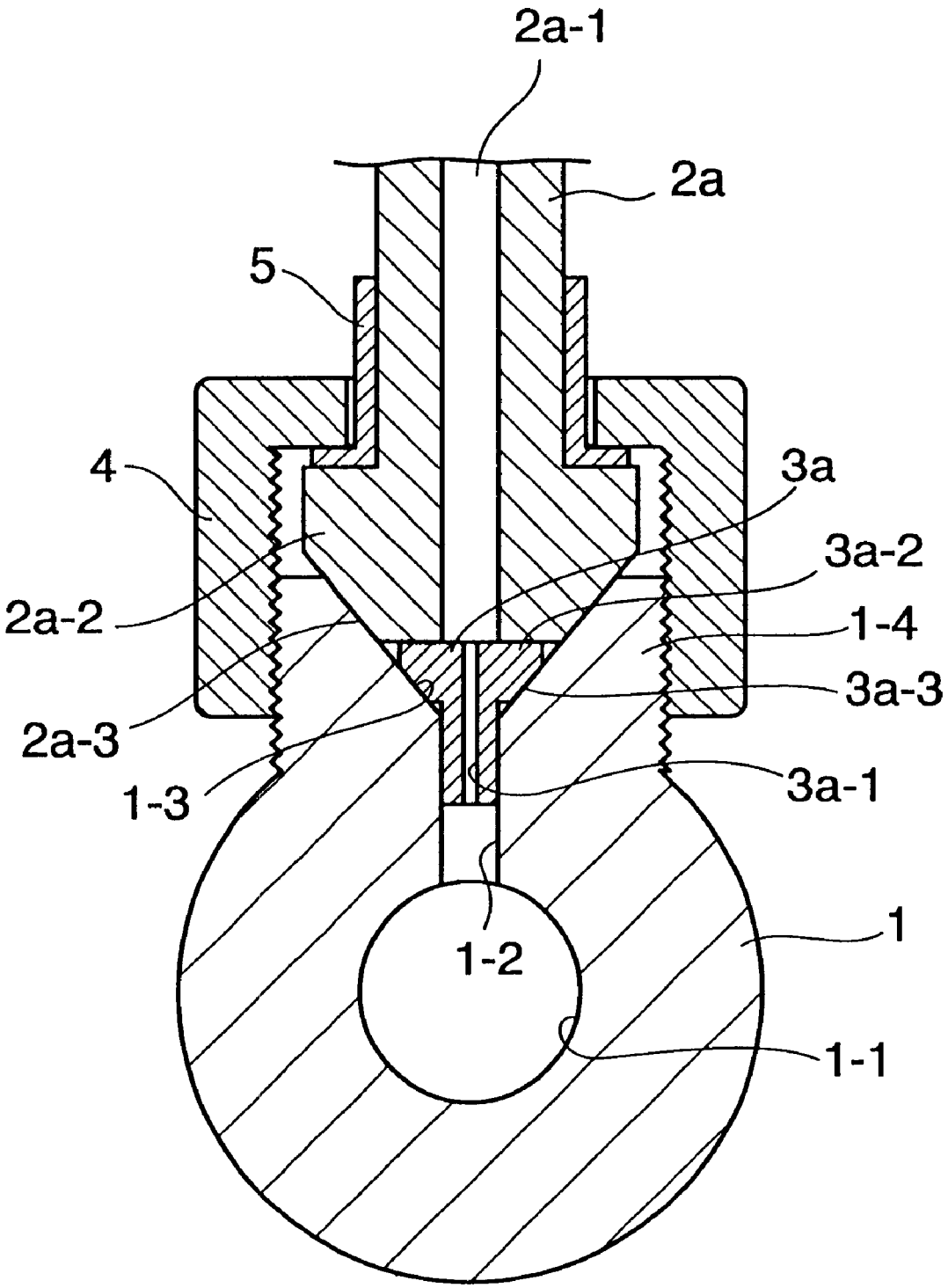
FIG. 1 is a vertical sectional view showing an embodiment (first embodiment) of a common rail having an integrated type boss portion according to the invention.

According to the invention, numerals 1, 11, 21 and 31 designate main pipe rails, notations 2*a*, 2*b*, 2*c*, 2*d*, 2*e* and 2*f* designate injection pipes, notations 3*a*, 3*b*, 3*c*, 3*d*, 3*e* and 3*f* designate orifice pipes, numerals 4, 14, 24 and 34 designated fastening nuts, numerals 5 and 15 designate sleeve washers and numeral 13 designates a joint metal piece.

That is, a common rail shown in FIG. 11 is constituted such that each of a plurality of pieces of integrated type boss portions 1-4 provided, at intervals, at a peripheral wall portion in an axial direction on a side of the main pipe rail 1 comprising a circular pipe, is perforated with a branch hole 1-2 communicating with a communication path 1-1 of the main pipe rail 1 and having a pressure receive seat face 1-3 opened outwardly, and inside of the branch hole 1-2 is fitted to and fixedly attached with the orifice pipe 3*a* having an outer diameter substantially the same as a hole diameter of the branch hole, having an orifice hole 3*a*-1 with a smaller diameter and attached with a flange 3*a*-2, is fitted into and fixedly attached to the branch hole 1-2 and the orifice pipe 3*a* is provided with a seat face 3*a*-3 constituting the flange 3*a*-2 in a thick wall having a diameter larger than a flow path diameter of the injection pipe and constituting an inclined face the same as that of the pressure receive seat face 1-3 at an end face of an outer periphery thereof to be brought into contact with and fixed by the pressure receive seat face 1-3.

Meanwhile, there is constituted a system in which on a side of the injection pipe 2*a* having a flow path 2*a*-1, a pressing seat face 2*a*-3 constituted by a connection head portion 2*a*-2, is brought into contact and engaged with the pressure receive seat face 1-3 on the side of the main pipe rail 1 and is fastened to connect thereto in accordance with pressing operation under a neck of the connection head portion 2*a*-2 by screwing the fastening nut 4 previously integrated to the side of the injection pipe via the sleeve washer 5 to the boss portion 1-4. Further, as means for fixedly attaching the orifice pipe 3*a*, there is used means of press-fitting, calking, shrinkage fitting, chill fitting, soldering, bonding or the like as described above.

Figure 2:
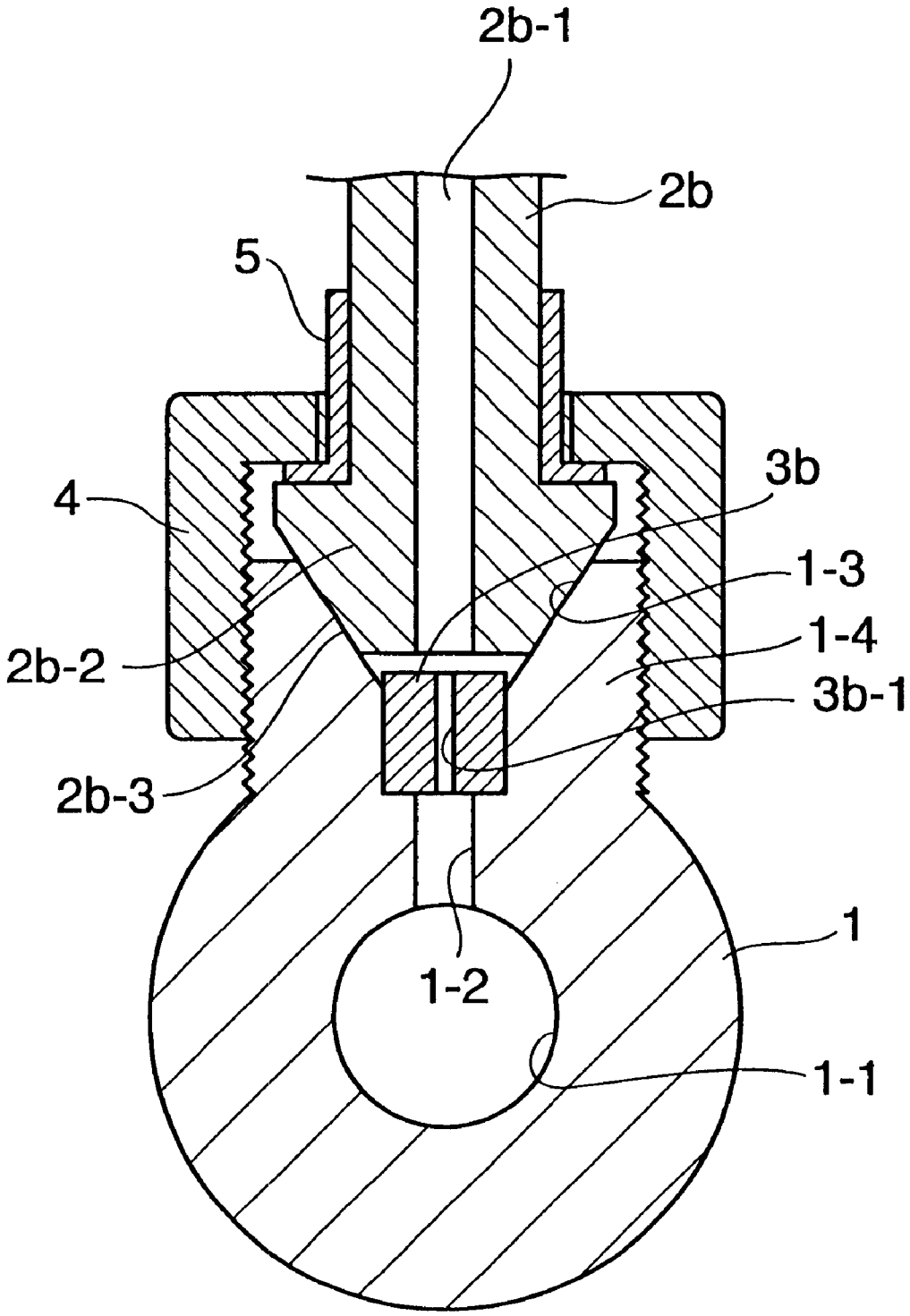
FIG. 2 is a vertical sectional view showing other embodiment (second embodiment) having an integrated type boss portion similarly according to the invention.

Next, similar to FIG. 1, a common rail shown by FIG. 2 is constituted such that the branch hole 1-2 communicated with the communication path 1-1 of the main pipe rail 1 and having the pressure receive seat face 1-3 opened outwardly, is perforated at each of the plurality of pieces of boss portions 1-4 provided, at intervals, at the peripheral wall portion in the axial direction of the side of the main pipe rail 1 comprising a circular pipe and the orifice pipe 3*b* having an orifice hole 3*b*-1 having a diameter far smaller than the hole diameter of the branch hole and having a diameter larger than the branch hole 1-2, is fitted into and fixedly attached to the portion of the branch hole 1-2.

Meanwhile, on the side of the injection pipe 2*b* having a flow path 2*b*-1, similar to FIG. 1, there is constituted a system in which a pressing seat face 2*b*-3 constituted a by a connection head portion 2*b*-2, is brought into, contact and engaged with the pressure receive seat face 1-3 on the side of the main pipe rail 1 and is fastened to connect thereto in accordance with pressing operation under a neck of the connection head portion 2*b*-2 by screwing the fastening nut 4 previously integrated to the side of the injection pipe via the sleeve washer 5 to the boss portion 1-4. Further, as means for fixedly attaching the orifice pipe 3*b*, similar to the above-described, there is used means of press-fitting, calking, shrinkage fitting, chill fitting, soldering, bonding or the like.

Figure 3:
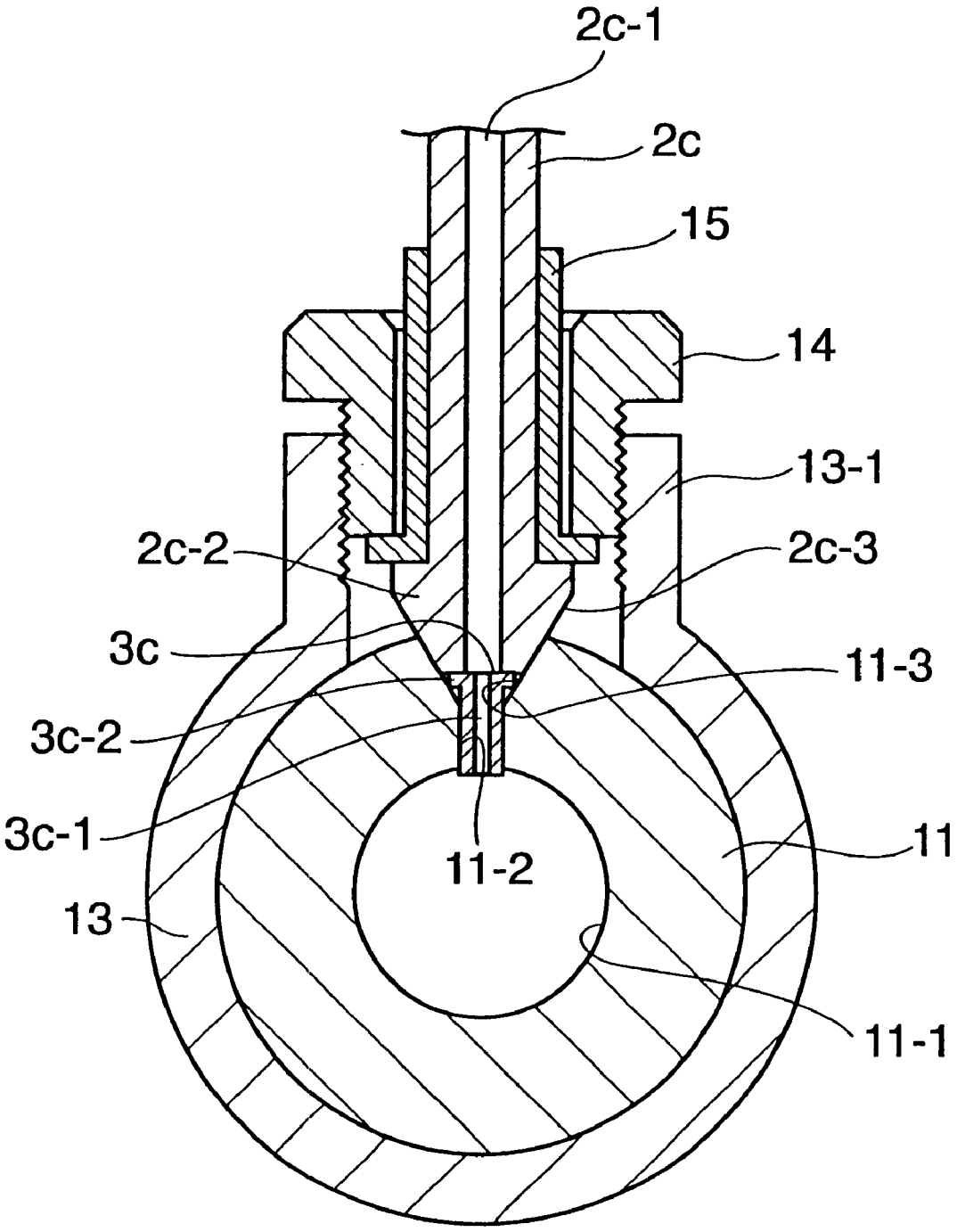
FIG. 3 is a vertical sectional view showing an embodiment (third embodiment) of a common rail having a separate type boss portion similarly according to the invention.

Next, a common rail having a separate type boss portion as shown by FIG. 3 is constituted such that in a system in which a portion of a branch hole 11-2 communicating with a communication path 11-1 at an inner portion provided at a peripheral wall portion on the side of the main pipe rail 11 comprising a circular pipe, is made to constituted a pressure receive seat face 11-3 opened outwardly, by using the joint metal piece 13 in a ring-like shape surrounding an outer peripheral portion of the main pipe rail 11 at a vicinity of the pressure receive seat face, a pressing seat face 2*c*-3 constituted by a connection head portion,2*c*-2 on the side of the injection pipe 2*c* having a flow path 2*c*-1 similar to the above-described, is brought into contact and engaged therewith and fastened to connect thereto in accordance with pressing operation under a neck of the connection head portion 2*c*-2 by screwing a portion of a screw wall 13-1 projected from the joint metal piece 13 with the fastening nut 14 previously integrated to the side of the injection pipe 2*c* via the sleeve washer 15, the orifice pipe 3*c* having an outer diameter substantially the same as the hole diameter of the branch hole, having an orifice hole 3*c*-1 having a smaller diameter and attached with a flange 3*c*-2, is fitted into and fixedly attached to the branch hole 11-2, and similar to the constitution shown in FIG. 1, the orifice pipe 3*c* is provided with a seat face constituting an inclined face the same as the pressure receive seat face 11-3 at an end face of an outer periphery of the flange 3*c*-2 to be brought into contact with and fixed by the pressure receive seat face 11-3.

Further, similar to the above-described, also as the means for fixedly attaching the orifice pipe 3*c*, there is used means of press-fitting, calking, shrinkage fitting, chill fitting, soldering, bonding or the like.

Figure 4:
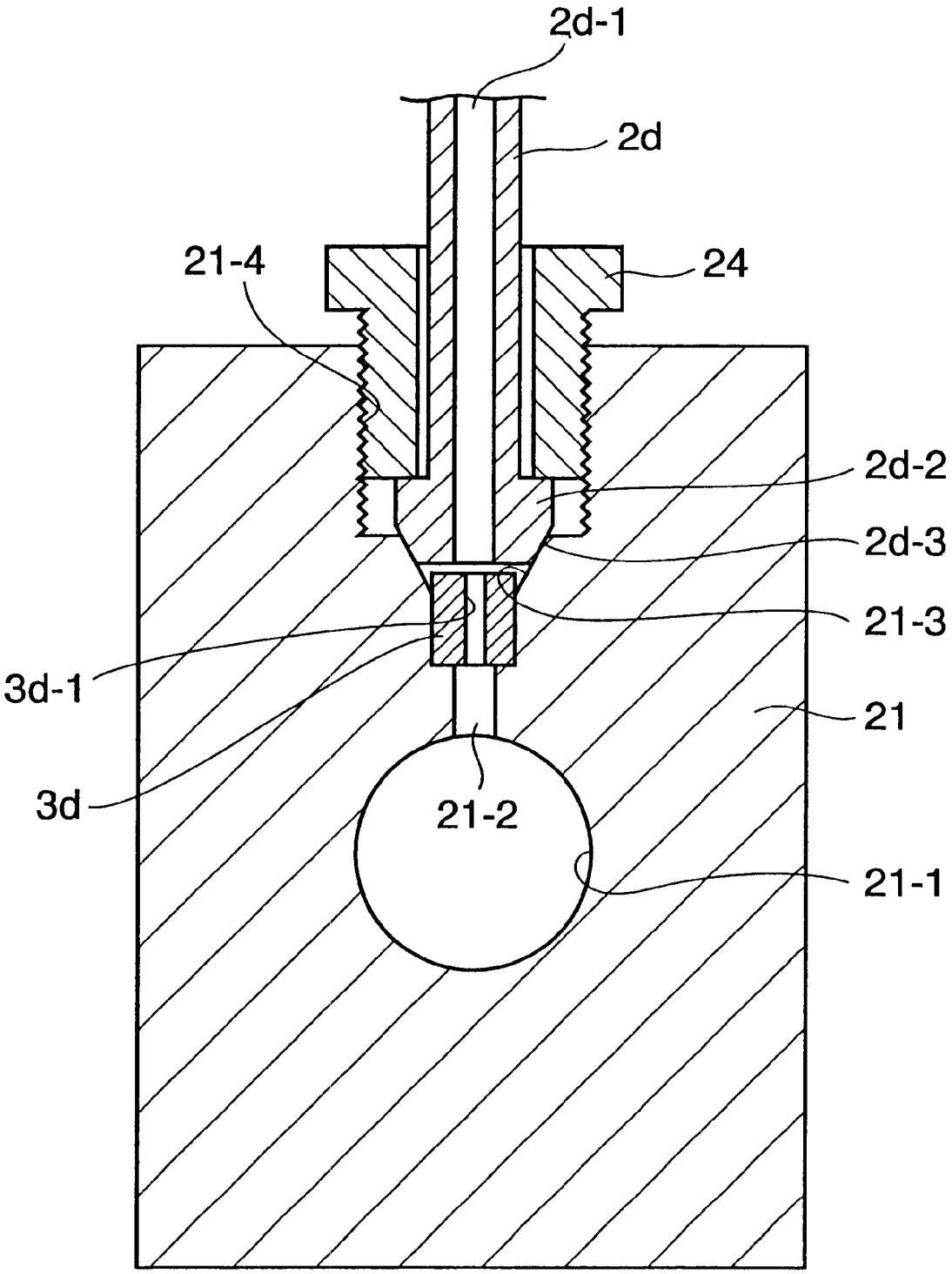
FIG. 4 is a vertical sectional view showing an embodiment (fourth embodiment) of a block rail type common rail similarly according to the invention.

Further, the invention is applicable also to a block rail type common rail as shown by FIG. 4.

That is, a connection structure of an injection pipe for a block rail type common rail shown by FIG. 4 is constituted such that a bottom portion of each of a plurality of pieces of connection hole portions 21-4 provided, at intervals, at a peripheral wall,portion in an axial direction of a side of the main pipe rail 21 comprising a block having a section in a rectangular shape and having a communication path 21-1 at an inner portion thereof, is perforated with a branch hole 21-2 communicating with the communication path 21-1 of the main pipe rail 21 and having a pressure receive seat face 21-3 opened outwardly and the orifice pipe 3*d* having an orifice hole 3*d*-1 having a diameter far smaller than the hole diameter of the branch hole and having a diameter larger than the branch hole 21-2, is fitted into and fixedly attached to a portion of the branch hole 21-2.

Meanwhile, on the side of the injection pipe 2*d* having a flow path 2*d*-1, there is constituted a system in which a pressing seat face 2*d*-3 constituted by a connection head portion 2*d*-2 similar to the above-described is brought into contact and engaged with the pressure receive seat face 21-3 on the side of the main pipe rail 21 and is fastened to connect thereto in accordance with pressing operation under a neck of a connection head portion 2*d*-2 by screwing the fastening outer screw nut 24 previously integrated to the side of the injection pipe 2*d* with the connection hole portion 21-4.

Further, also as means for fixing the orifice pipe 3*d*, similar to the above-described, there is used means of press-fitting, calking, shrinkage fitting, chill fitting, soldering, bonding or the like.

Figure 5:
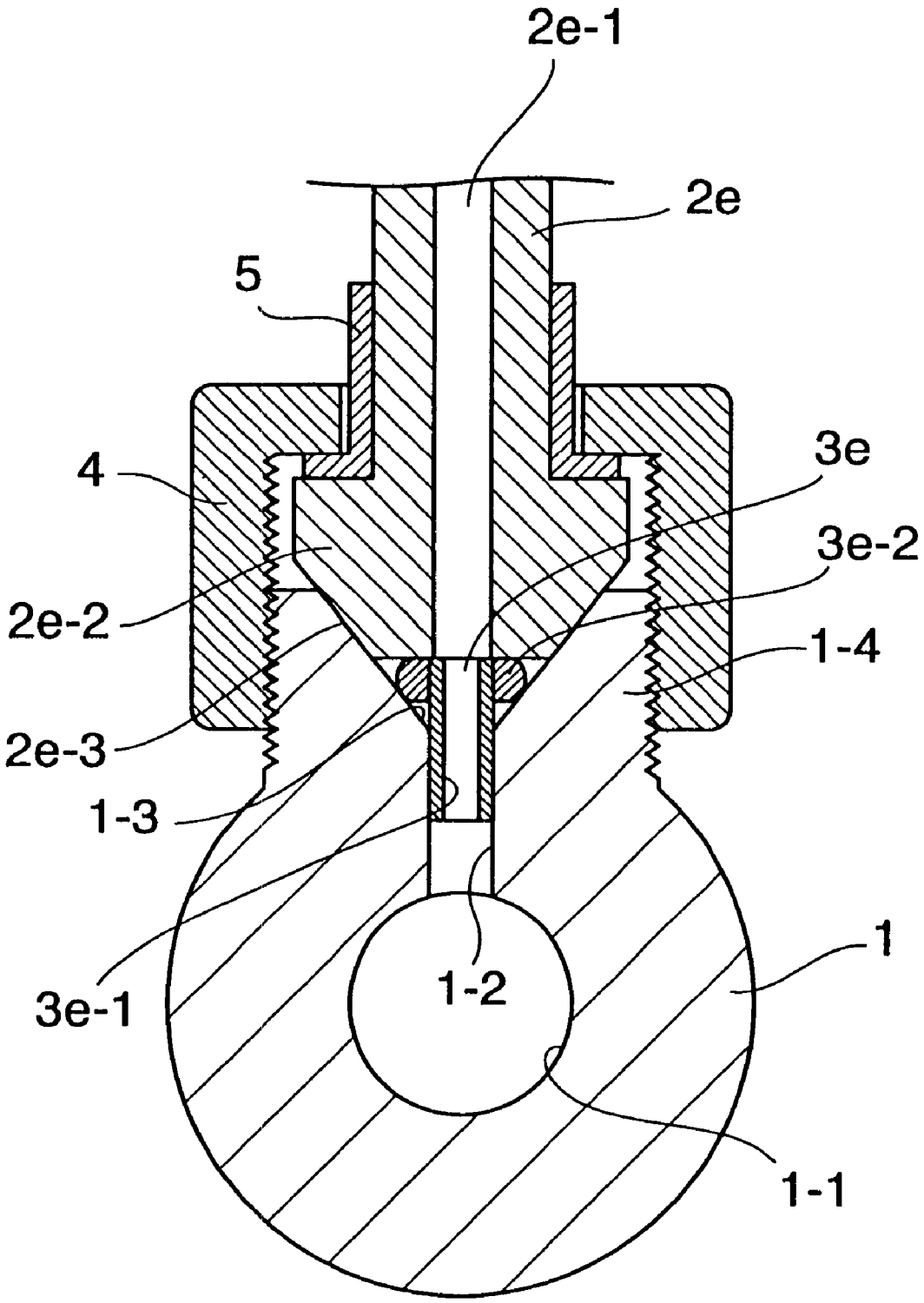
FIG. 5 is a vertical sectional view showing other embodiment (fifth embodiment) of a common rail having an integrated type boss portion similarly according to the invention.
Figure 6:
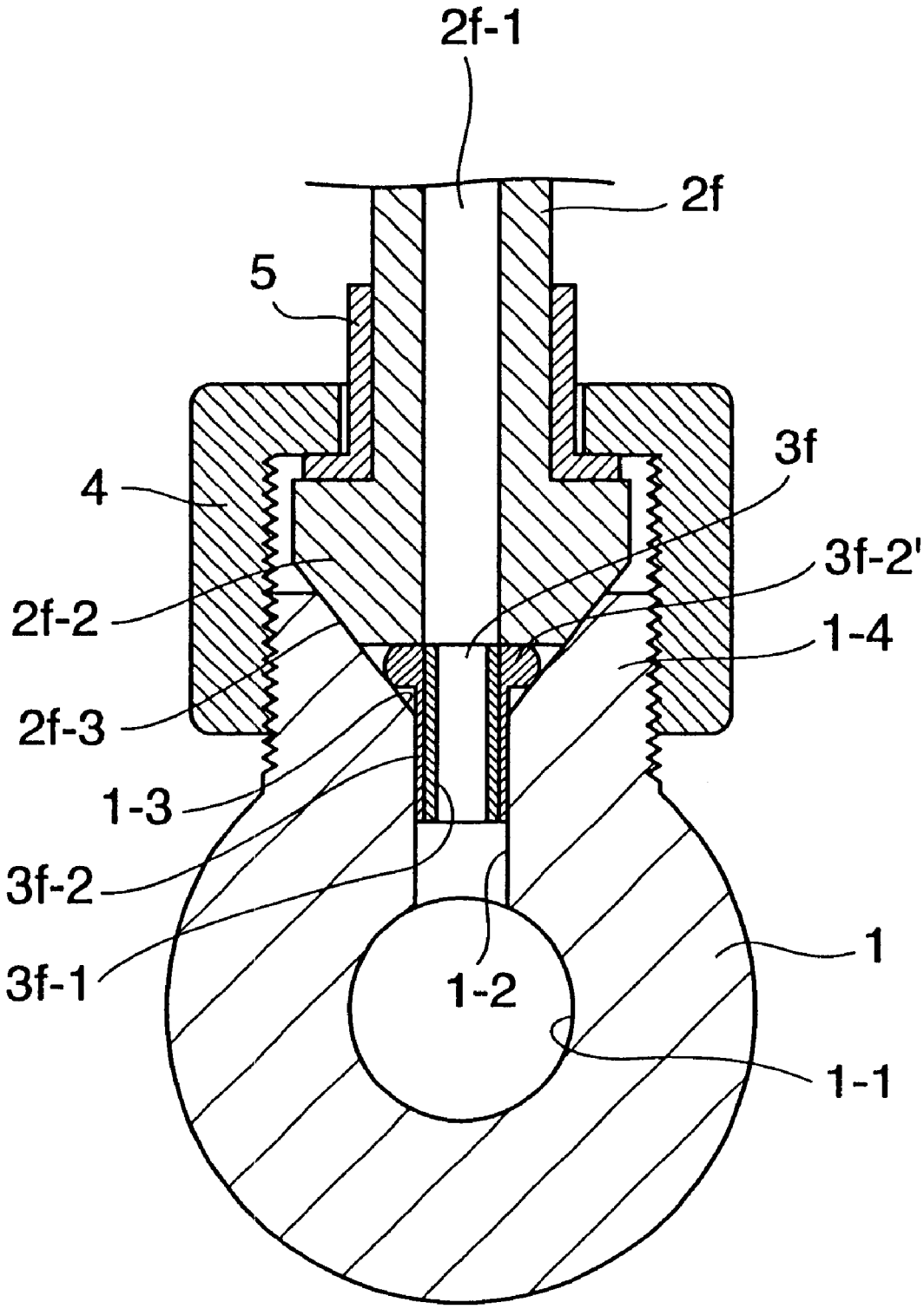
FIG. 6 is a vertical sectional view still other embodiment (sixth embodiment) of a common rail having an integrated type boss portion similarly according to the invention.
Figure 7:
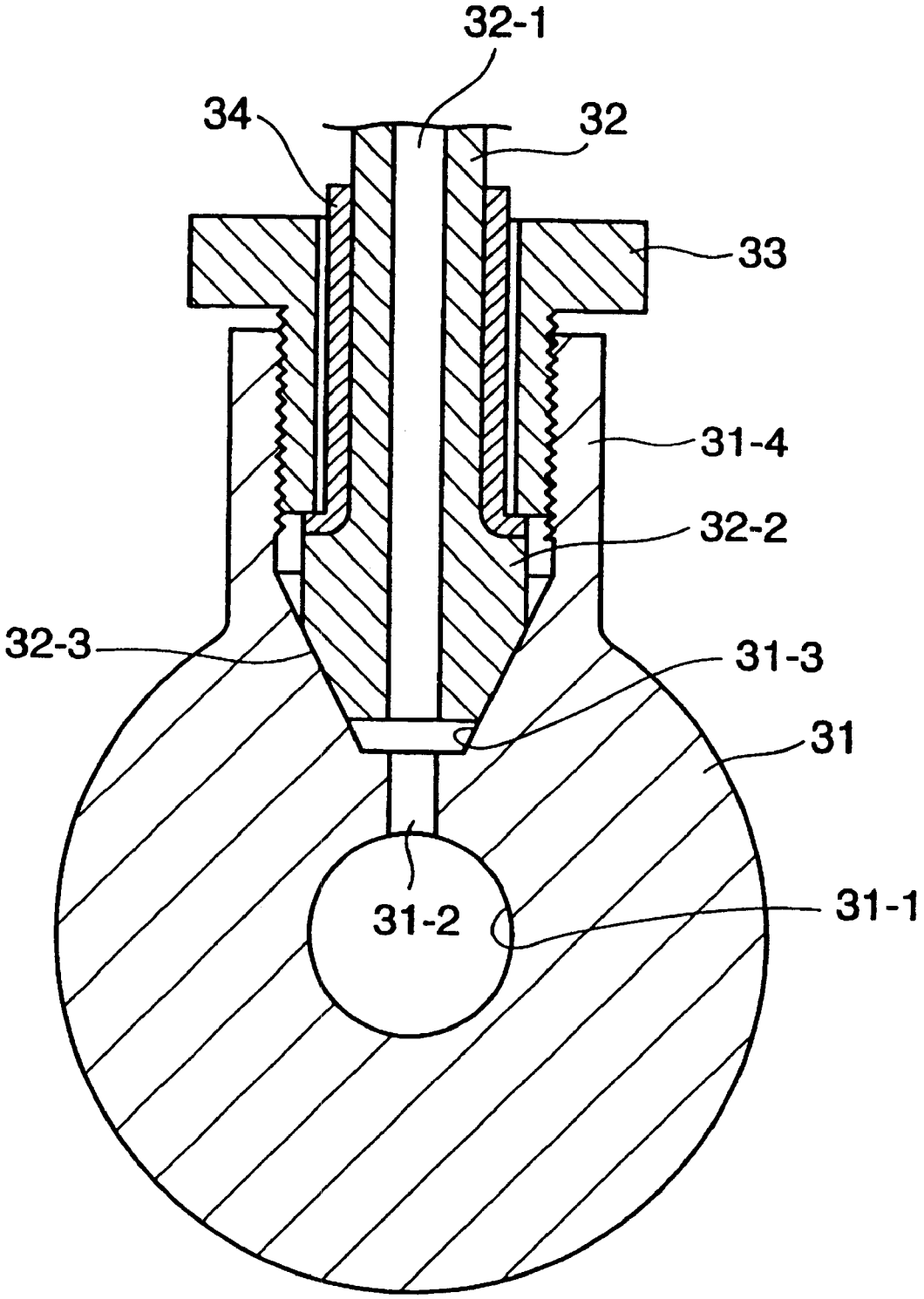
Fig. 7 PRIOR ART
FIG. 7 is a vertical sectional view showing an example of an injection pipe connection structure of a conventional common rail constituting an object of the invention.
Figure 8:
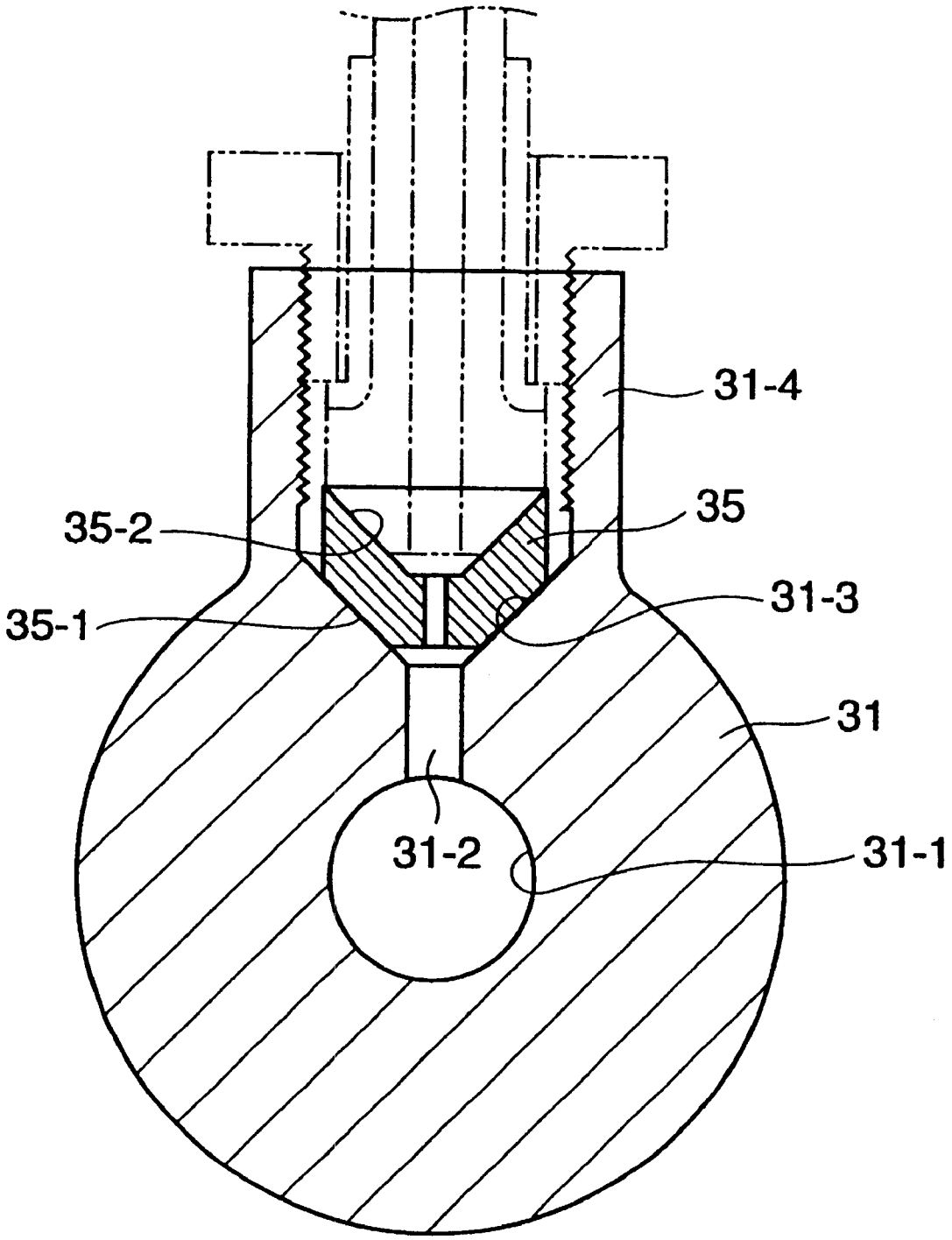
Fig. 8 PRIOR ART
FIG. 8 is a vertical sectional view showing an example of pressure variation restraining means in the injection pipe connection structure of the common rail, mentioned above.

Meanwhile, FIG. 5 ad FIG. 6 show examples in each of which an orifice pipe fabricated by metals having deferent materials is applied to the common rail having the integrated type boss portion shown in FIG. 1.

That is, a common rail shown in FIG. 5 is constructed by a constitution similar to that of the common rail shown in FIG. 1 other than the orifice pipe 3*e* and is constituted such that each of the plurality of pieces of integrated type boss portion 1-4 provided, at intervals, at the peripheral wall portion in the axial direction of the side of the main pipe rail 1 comprising a circular pipe, is perforated with the branch hole 1-2 communicating with the communication path 1-1 of the main pipe rail 1 and having the pressure receive seat face 1-3 opened outwardly and the orifice pipe 3*e* comprising a pipe member 3*e*-1 made of a hard metal having an outer diameter substantially the same as the hole diameter of the branch hole and a ring 3*e*-2 made of a soft metal having a diameter larger than a flow path diameter of the injection pipe 2*e* outwardly fitted to an end portion of the pipe member on the side of a connection head portion 2*e*-2 thereof, is fitted into and fixedly attached to the branch hole 1-2 and the ring 3*e*-2 made of a soft metal of the orifice pipe 3*e* is made thick-walled to be brought into contact with and fixed by an opposed member. Further, also as means for fixing the orifice pipe 3*e*, there is used means of press-fitting, calking, shrinkage fitting, chill fitting, soldering, bonding or the like.

On the side of the injection pipe 2*e* having a flow path 2*e*-1, similar to FIG. 1, there is constituted a system in which a pressing seat face 2*e*-3 constituted by the connection head portion 2*e*-2 is brought into contact and engaged with the pressure receive seat face 1-3 on the side of the main pipe rail 1 and is fastened to connect thereto in accordance with pressing operation under a neck of the connection head portion 2*e*-2 by screwing the fastening nut 4 previously integrated to the side of the injection pipe via the sleeve washer 5 with the boss portion 1-4.

Similar to the common rail shown in FIG. 5, a common rail shown in FIG. 6 is constructed by a constitution, similar to the common rail shown, in FIG. 1 other than the orifice pipe 3*f* and is constituted such that each of the plurality of pieces of integrated type boss portion is 1-14 provided, at intervals, at the peripheral wall portion in the, axial, direction on the side of the main pipe rail 1 comprising a circular pipe, is perforated with the branch hole 1-2 communicating with the communication path 1-1 of the main pipe, rail 1 and having the pressure receive seat face 1-3 opened outwardly and the orifice pipe 3*f* comprising an outer pipe 3*f*-2 made of a soft metal having an outer diameter substantially the same as the diameter of the branch hole and having a flange portion 3*f*-21 having a diameter larger than the flow path diameter of the injection pipe at an end portion thereof on a side of a connection head portion 2*f*-2 of the injection pipe 2*f*, and an inner pipe 3*f*-1 made of a hard metal having a wall thickness substantially the same as that of the outer pipe, is fitted into and fixedly attached to the branch hole 1-2 and the branch portion 3*f*-2' of the outer pipe 3*f*-2 of the orifice pipe 3*f* is made thick-walled to be brought into contact with and fixed by, an opposed member. Further, also as means for fixedly attaching the orifice pipe 3*f*, similar to the above-described, there is used press-fitting, calking, shrinkage fitting, chill fitting, soldering, bonding or the like.

Meanwhile, on the side of the injection pipe 2*f* having a flow path 2*f*-1, similar to FIG. 1, there is constituted a system in which a pressing seat face 2*f*-3 constituted by the connection head portion 2*f*-2, is brought into contact and engaged with the pressure receive seat face 1-3 on the side of the main pipe rail 1and is fastened to connect thereto in accordance with,pressing operation under a neck of the connection head portion 2*f*-2 by screwing the fastening nut 4 previously integrated to the side of the injection pipe via the sleeve washer 5 to the boss portion 1-4.

The main rail 1 or 11 as the common rail according to the embodiment, is frequently a forged product having, for example, a diameter of 28 mm and a wall thickness, of 9 mm and comprising material S45C having a comparatively thick-walled tubular portion, in which an axis core inner portion thereof is made to constitute the communication path by mechanical working such as boring, gun drilling or the like and there are respectively provided the plurality of pieces of integrated type boss portions or separate type boss portions or connection hole portions in the case of the block rail type at the peripheral wall portion in the axial direction maintaining intervals there between. Further, the common rail having the integrated type boss portion is not limited to the above described connection structure but is naturally applicable to a system in which although not illustrated, a branch hole communicating with a communication path is extended up to a vicinity of a free end portion of a boss portion, a pressure receive seat face is formed to expose to the free end portion of the boss portion and by fabricating a female screw at an inner periphery of the boss portion and screwing a nut to the female screw, the orifice pipe is fastened to connect in accordance with pressing operation under a neck of a connection head portion of the injection pipe.

As has been explained above, the common rail in accordance with the invention is constituted by fitting and fixedly attaching the orifice pipe to the branch hole portion or the connection hole portion, there is achieved an excellent effect in which the orifice pipe serves only as the orifice and does not influence on the seal performance and accordingly, the stability of seal is excellent, fuel can be injected stably by restraining pulsation lowly and retarding propagation.

What is claimed is:

1. A common rail comprising a branch hole communicating with a communication path and having a pressure receive seat face opened outwardly at each of a plurality of pieces of integrated type boss portions or separate type boss portions provided at a peripheral wall portion in an axial direction of a main pipe rail having the communication path at inside thereof in an axis core direction thereof while maintaining intervals there between, bringing and engaging a pressing seat face portion constituted by a connection head portion having a flow path communicating with the communication path and provided at an end portion thereof in contact with the pressure receive seat face and fastening to connect the pressing seat face portion thereto in accordance with pressing operation under a neck of the connection head portion by screwing a fastening nut, wherein said common rail is constituted by providing an orifice pipe having an outer diameter at least the same as a hole diameter of the branch hole in the branch hole.

2. The common rail according to claim 1 ,wherein the orifice pipe includes a thick-walled flange portion having a diameter larger than a flow path diameter of an injection pipe at an end portion of the injection pipe on a side of the connection head portion.

3. The common rail according to claim 1 or 2, wherein the orifice pipe comprises a pipe member made of a hard metal and a ring made of a soft metal having a diameter larger than a flow path diameter of the injection pipe outwardly fitted to an end portion of the pipe member on a side of the connection head portion.

4. The common rail according to claim or 2, wherein the orifice pipe comprises an inner pipe made of a hard metal and an outer pipe made of a soft metal having a thick-walled flange portion having a diameter larger than flow path diameter of the injection pipe at an end portion of the injection pipe on, aside of the connection head portion.

5. The common rail according to claim 1, wherein the orifice pipe comprises a pipe member made of a hard metal and a ring made of a soft metal having a diameter larger than a flow path diameter of the injection pipe outwardly fitted to an end portion of the pipe member on a side of the connection head portion.

6. The common rail according to claim 1, wherein the orifice pipe comprises an inner pipe made of a hard metal and an outer pipe made of a soft metal having a thick-walled flange portion having a diameter larger than a flow path diameter of the injection pipe at an end portion of the injection pipe on a side of the connection head portion.

7. A common rail comprising an axially extending main pipe rail having an axially aligned communication path therein, a plurality of bosses extending transversely from the main pipe rail at selected intervals, each said boss having a branch hole formed therethrough and communicating with the communication path of the main pipe rail, portions of the branch hole remote from the communication path defining an outwardly flared pressure receiving seat face, a plurality of injection pipes, each said injection pipe having a flow path extending centrally therethrough, each said injection pipe further having an axial end defining a connection head with a convexly tapered pressing seat face, the pressing seat faces of the respective injection pipes being engaged against the pressure receiving seat faces of the respective bosses of the main pipe rail, a plurality of fastening nuts engaging portions of the connection heads of the respective injection pipes and urging the pressing seat faces of the respective injection pipes tightly against the pressure receiving seat faces of the respective bosses, and each said boss further comprising an orifice pipe engaged in the branch hole of the respective boss, the orifice pipe having an outer diameter substantially equal to an inside diameter of the respective branch hole in the boss.

8. The common rail of claim 7, wherein the orifice pipe further comprises an enlarged flange adjacent one end, the flange of the orifice pipe being cross-sectionally larger than the branch hole in the boss of the main pipe and cross-sectionally larger than the flow path through the respective injection pipe, the flange further comprising a convexly tapered face seated against the pressure receiving seat face of the respective boss.

* * * * *